US006001005A

United States Patent [19]

Anderson, III et al.

[11] Patent Number: 6,001,005

[45] Date of Patent: Dec. 14, 1999

[54] POLISHING APPARATUS

[75] Inventors: Robert L. Anderson, III, Scottsdale, Ariz.; Michael Manseau, Chicago, Ill.; Janusz Aleksander Derza, Prospect Heights, Ill.; John Edward Bussan, Libertyville, Ill.

[73] Assignee: Speedfam Corporation, Chandler, Ariz.

[21] Appl. No.: 09/071,442

[22] Filed: May 1, 1998

Related U.S. Application Data

[63] Continuation-in-part of application No. 08/932,578, Sep. 19, 1997.

[51] Int. Cl.[6] ..... B24B 49/08

[52] U.S. Cl. ..... 451/268; 451/19

[58] Field of Search ..... 451/269, 268, 451/262, 288, 287, 290, 291, 19

[56] References Cited

U.S. PATENT DOCUMENTS

| | | | |
|---|---|---|---|
| 240,966 | 5/1881 | Chappell | 451/268 X |
| 1,838,553 | 12/1931 | Kadow et al. | 451/265 |
| 2,618,911 | 11/1952 | Indge | 51/118 |
| 2,688,215 | 9/1954 | Roshong et al. | 51/118 |
| 2,822,647 | 2/1958 | Rips et al. | 51/133 |
| 2,963,830 | 12/1960 | Hook | 451/291 |
| 2,979,868 | 4/1961 | Emeis | 51/131 |
| 3,225,492 | 12/1965 | Day et al. | 451/264 X |
| 3,537,214 | 11/1970 | Ford | 451/264 |
| 3,691,694 | 9/1972 | Goetz et al. | 451/269 |
| 3,791,083 | 2/1974 | Messerschmidt | 451/268 X |
| 3,848,365 | 11/1974 | Bovensiepen et al. | 451/262 |
| 3,898,770 | 8/1975 | Benz et al. | 51/129 |
| 3,925,936 | 12/1975 | Orlov et al. | 51/118 |
| 3,986,433 | 10/1976 | Walsh et al. | 90/15 |
| 4,007,560 | 2/1977 | Janssen | 451/262 |
| 4,194,324 | 3/1980 | Bonora et al. | 51/131.5 |
| 4,205,489 | 6/1980 | Orlov et al. | 51/118 |
| 4,315,383 | 2/1982 | Day | 51/118 |
| 4,459,785 | 7/1984 | Zimmer | 51/237 R |
| 4,502,252 | 3/1985 | Iwabuchi | 51/118 |
| 4,592,169 | 6/1986 | Klievoneit et al. | 51/118 |
| 4,593,495 | 6/1986 | Kawakami et al. | 51/118 |
| 4,707,945 | 11/1987 | Arai | 51/118 |
| 4,742,651 | 5/1988 | Wittstock | 451/262 X |
| 4,773,185 | 9/1988 | Taira | 51/118 |
| 4,805,348 | 2/1989 | Arai et al. | 51/118 |
| 4,860,498 | 8/1989 | Gosis | 51/165 |
| 4,916,868 | 4/1990 | Wittstock | 51/281 |
| 4,962,616 | 10/1990 | Wittstock | 51/165 |
| 5,016,399 | 5/1991 | Vinson | 51/118 |
| 5,121,572 | 6/1992 | Hilscher | 451/262 X |
| 5,140,774 | 8/1992 | Onodera | 51/134 |
| 5,205,082 | 4/1993 | Shendon et al. | 51/283 |
| 5,329,732 | 7/1994 | Karlsrud et al. | 51/131.5 |
| 5,377,451 | 1/1995 | Leoni et al. | 451/287 |
| 5,595,529 | 1/1997 | Cesna et al. | 451/291 |
| 5,645,472 | 7/1997 | Nagahashi et al. | 451/261 |
| 5,782,678 | 7/1998 | Cesna et al. | 451/291 |

FOREIGN PATENT DOCUMENTS

| | | | |
|---|---|---|---|
| 3120077 | 5/1988 | Japan | 451/291 |

OTHER PUBLICATIONS

SpeedFam–Spitfire Brochure entitled "Double–Sided Abrasive Machining System 360", Copyright 1994.

*Primary Examiner*—Robert A. Rose
*Attorney, Agent, or Firm*—Fitch, Even, Tabin & Flannery

[57] ABSTRACT

A polishing machine includes a platform assembly mounted within three support columns. The platform assembly includes fluidically pressurized bladders for urging the upper polish plate toward and away from the lower polish plate. In one embodiment a movable support column is suspended from an overlying frame. The support column is engaged with the upper polish plate so as to selectively raise and lower the platform assembly. In another embodiment, the platform is raised and lowered by threaded shafts so as to engage and thereby displace the upper polish plate.

19 Claims, 11 Drawing Sheets

POLISHING APPARATUS

This is a continuation-in-part of prior application Ser. No. 08/932,578, filed Sep. 19, 1997. which is hereby incorporated herein by reference in its entirety. The entire disclosure of the prior application, from which a copy of the oath or declaration is supplied under paragraph 3 below, is considered as being part of the disclosure of the accompanying application, and is hereby incorporated by reference therein.

BACKGROUND OF THE INVENTION

1. Field of the Invention

The present invention pertains to polishing machines, and in particular to machines for imparting a well-defined finish to one or more workpieces. The present invention is especially adapted to the double-sided precision polishing of computer hard drive memory storage disks.

2. Description of the Related Art

Machines have been made available for providing a very smooth, well-defined surface finish on workpieces, such as computer hard drive memory storage disks. Although single-sided polishing has been performed to a limited extent, the commercial emphasis today is on the double-sided machining of memory disks, such that both major surfaces of a disk structure can be utilized for memory storage, thus reducing the size of memory devices, while allowing greater memory capacities to be provided for a hard drive component of a given size. Over time, the magnetic density of memory storage disks has grown substantially, with an ever increasing number of data bits being stored on a surface area of given size. As a result, data storage bits have occupied increasingly smaller portions of a disk surface. Accordingly, the surface characteristics of memory disks have drawn increasing attention, with routine, extremely well-defined polishing of the memory disk surface being required.

In an attempt to improve hard drive access times and memory transfer rates, memory storage disks are being driven at higher speeds of disk rotation. Accordingly, overall (or so-called "global") dimensions and tolerances of memory storage disks are becoming increasingly important for improved hard drive performance. Further, as disk speeds increase, it becomes necessary to hold the transducers, commonly termed "magnetic heads" as close as possible to the surface of the memory disk to obtain usable signal strength. Thus, increasing demands are being made to reduce total run out of the memory storage disks and surface variations of memory storage disks are being more closely examined with a view toward reducing "high spots" of ever diminishing height. Further, in certain types of hard disk drive mechanisms, parallelism of the double-sided surfaces is becoming increasingly important for attainment of desired device performance.

SUMMARY OF THE INVENTION

It is an object of the present invention to provide a high performance polishing machine that is inherently accurate, easy to use, and which is compatible with commercial manufacturing environments. It is important that such polishing machine be inherently stable during all phases of a polishing operation, without requiring special attention to changing conditions, and the effect that resulting excursions may have on the surface quality of the workpiece being treated.

In certain applications, it is required that the workpieces continue to rotate as polishing pressure is relieved and it is at these times that the polishing surfaces and the surrounding mechanism supporting those surfaces are permitted a certain freedom of movement. Any substantial misalignment or internal movement of the various cooperating components may result in unwanted contact of the polishing surfaces with the workpieces being treated, and it is an object of the present invention to control such contact.

It has been found important to examine the rigidity of the overall machine construction and to develop new structures for supporting the polishing members to eliminate unwanted motions, especially during critical moments, as when polishing pressure is being relaxed.

These and other objects of the present invention which will become apparent from studying the appended description and drawing are provided in an apparatus for polishing a workpiece, comprising:

a frame;

an upper polish plate;

a lower polish plate positioned beneath said upper polish plate;

a plate support shaft extending upwardly from said upper polish plate and having a central axis;

mounting means for mounting said plate support shaft for reciprocation in vertical directions and for rotation about its central axis;

a platform carried by said shaft for travel therewith, with said plate support shaft passing through said platform;

platform support means carried by said frame to engage said platform in a fixed position while allowing movement of said shaft relative to said platform; and positioning means comprising a double-acting fluidically pressurized bladder means carried by said platform and engaging said plate support shaft for displacing said plate support shaft and hence said upper polish plate with respect to said platform, so as to move said upper polish plate toward and away from said lower polish plate.

DETAILED DESCRIPTION OF THE PREFERRED EMBODIMENTS

Figure 1:
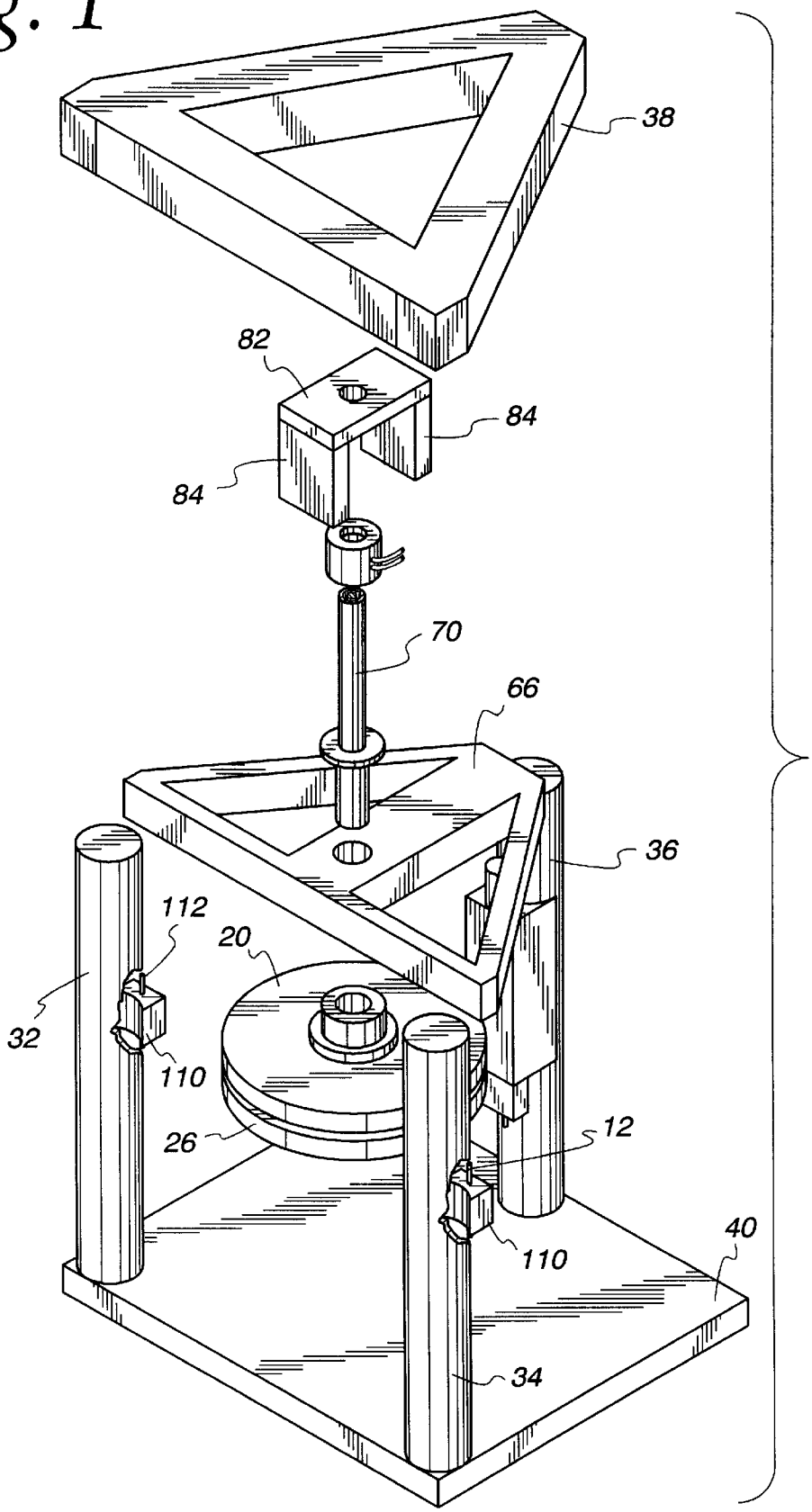
FIG. 1 is an exploded perspective view of polishing apparatus according to principles of the present invention.

Referring now to the drawings, and initially to FIGS. 1–11, a polishing tool 8 (see FIG. 10) according to principles of the present invention includes an internal machine arrangement shown in FIG. 1 and generally indicated at 10. The tool 8 has found immediate commercial acceptance in the field of polishing memory storage disk substrates, although tool 8 can also be readily adapted for other uses, including grinding, polishing, texturing and planarization of machine tool parts and integrated circuit wafers, for example.

In the preferred embodiment, a large number of workpieces, (e.g., fifty) memory disks, disk substrates, machine parts or other workpieces undergo simultaneous double-sided polishing, thereby providing important economies of manufacture for the tool user. In order to accommodate a large number of workpieces, work-cage mechanisms, including geared work holders or carriers 12 (see FIG. 11), are employed to confine the workpieces during a polishing operation. It is generally preferred that the work-cage mechanisms be of the planetary type where a plurality of carriers 12 are made to revolve between an outer ring gear 14 and a central "sun" gear 16. The outer geared edges of the carriers are enmeshed with the central sun gear, which imparts a rotary motion to the carriers, so that the workpieces move in respective, generally cycloidal paths, revolving about the axis of their carriers, as the carriers rotate with respect to the axis of the central sun gear. Also, rotations of the upper and lower polish plates and of the work cage mechanism disposed between the polish plates can be operated in reverse directions of rotation, as desired. By regulating the directions and speeds of rotation of the sun and ring gears, as well as the upper and lower polish plates, virtually any desired polishing action may be obtained.

Figure 10:
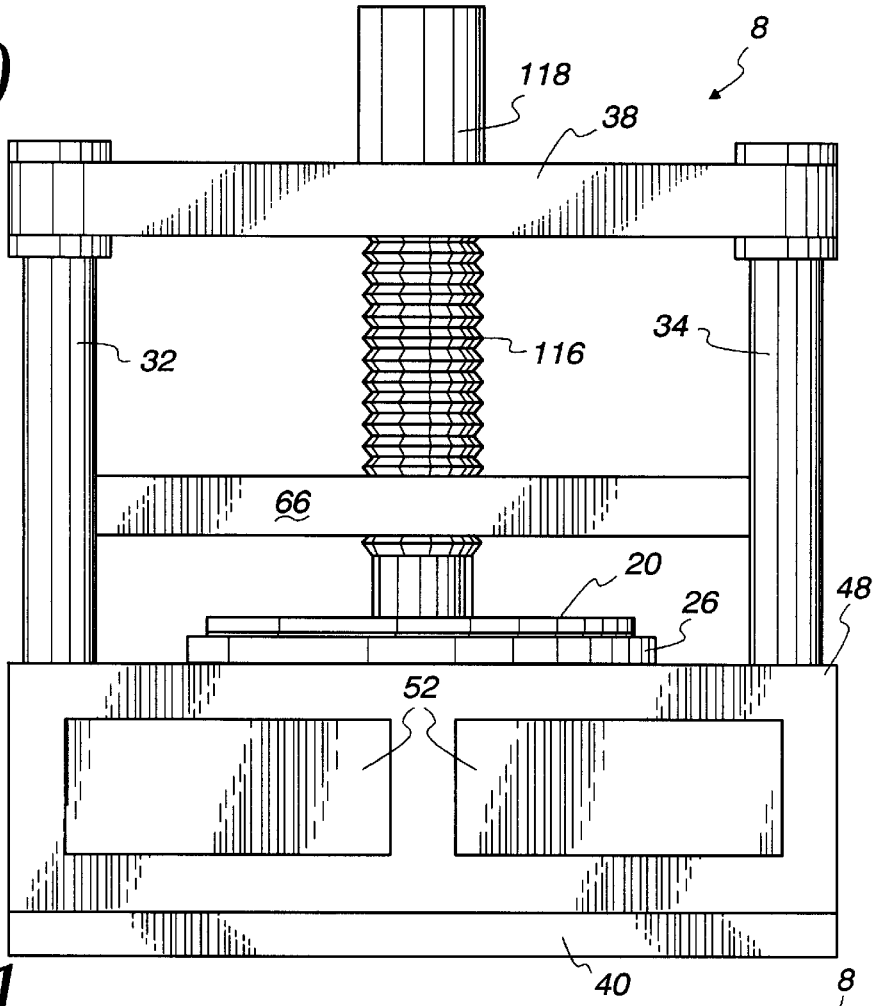
FIG. 10 is a front elevational view of a polishing tool.
Figure 11:
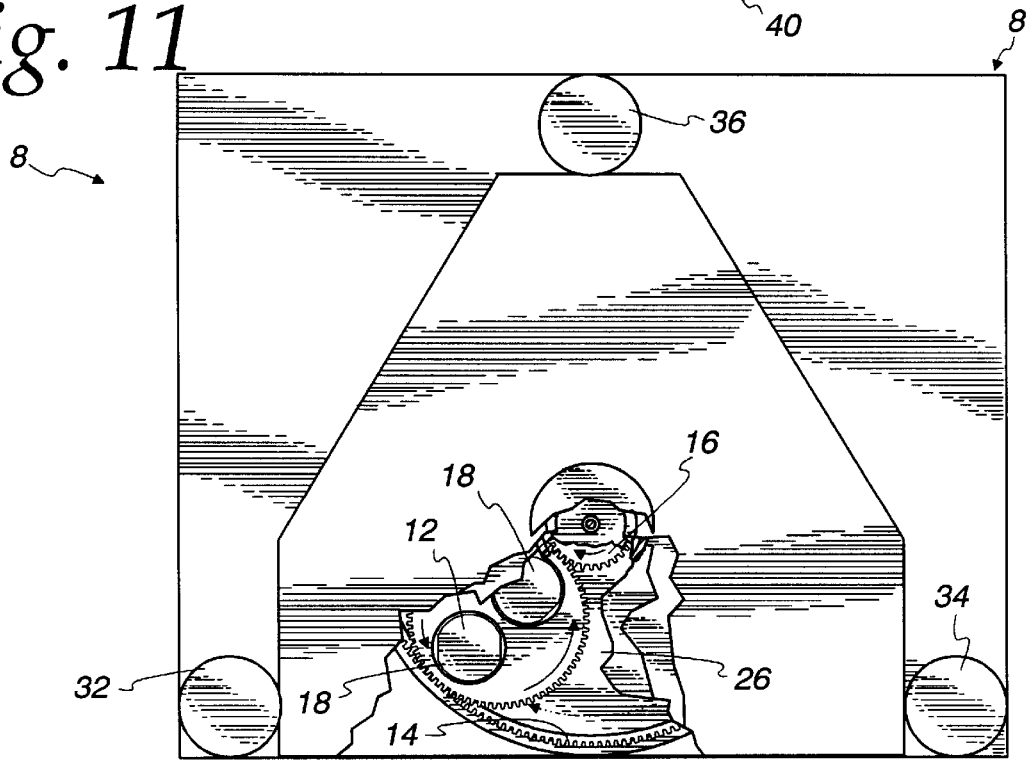
FIG. 11 is a top plan view thereof, shown partly broken away.
Figure 12A:
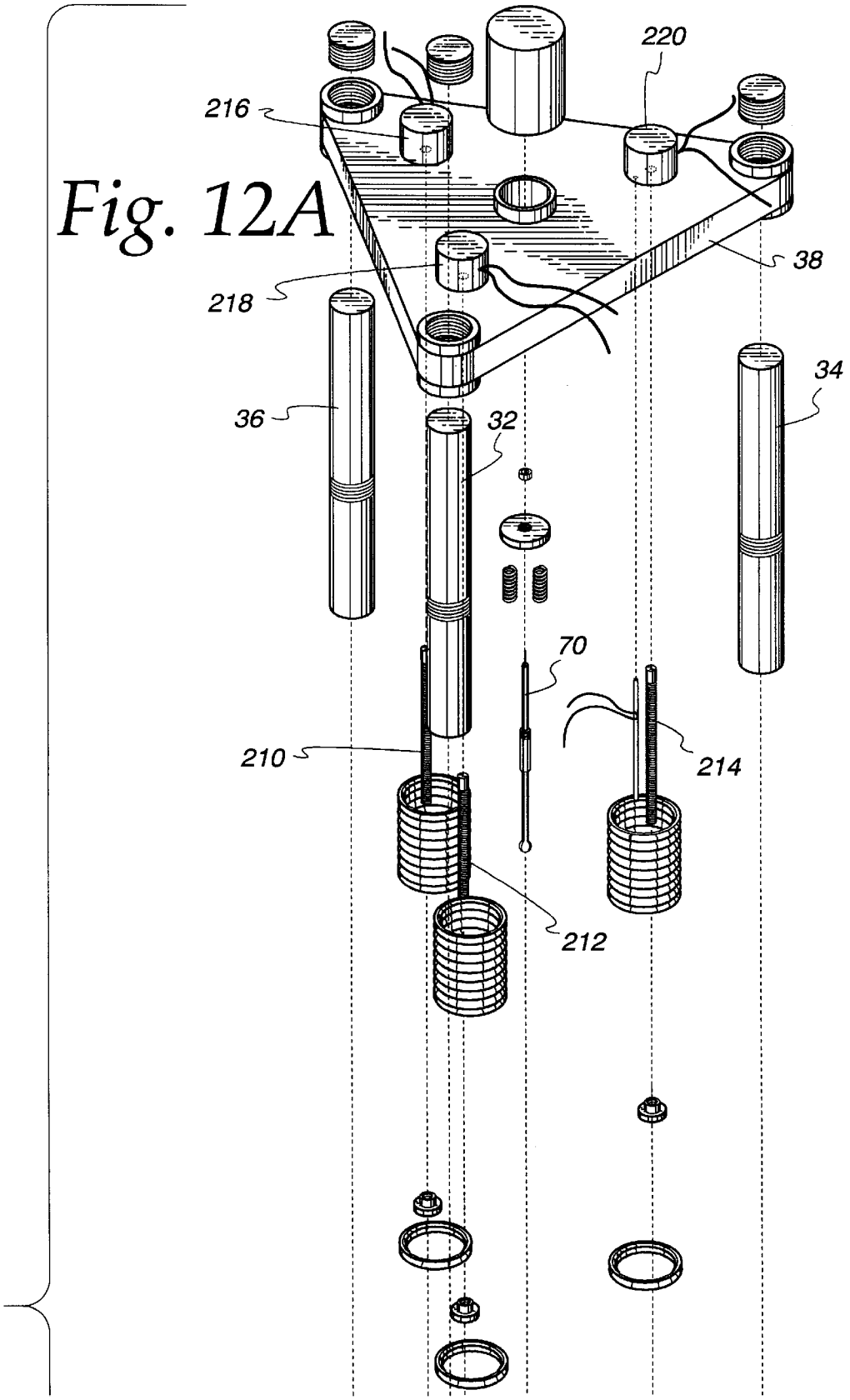
FIGS. 12A and 12B together comprise an exploded perspective view of an alternative polishing apparatus according to the principles of the present invention.

In the preferred embodiment, five memory disks 18 are loaded in each carrier, with ten carriers being intermeshed between the central sun gear and the outer, surrounding ring gear. Only two memory disks are shown in the figures for clarity of illustration. However, virtually any number of memory disks or other workpieces can be accommodated with appropriate changes in carrier design. The entire work-cage mechanism is rotated at an independently controllable speed, while the upper and lower polishing plates 20, 26 (see FIG. 12B, for example) are independently rotated at their own selected speeds. As will be seen herein, the upper polish plate 20 is driven from above by a motor 44 (see FIG. 12A) while the lower polish plate 26 is driven from below in a conventional manner, by equipment contained in a hollow base cabinet 48. Access to the equipment for driving the lower polish plate through access doors 52, as can be seen in FIG. 10.

Figures 12A, 12B:
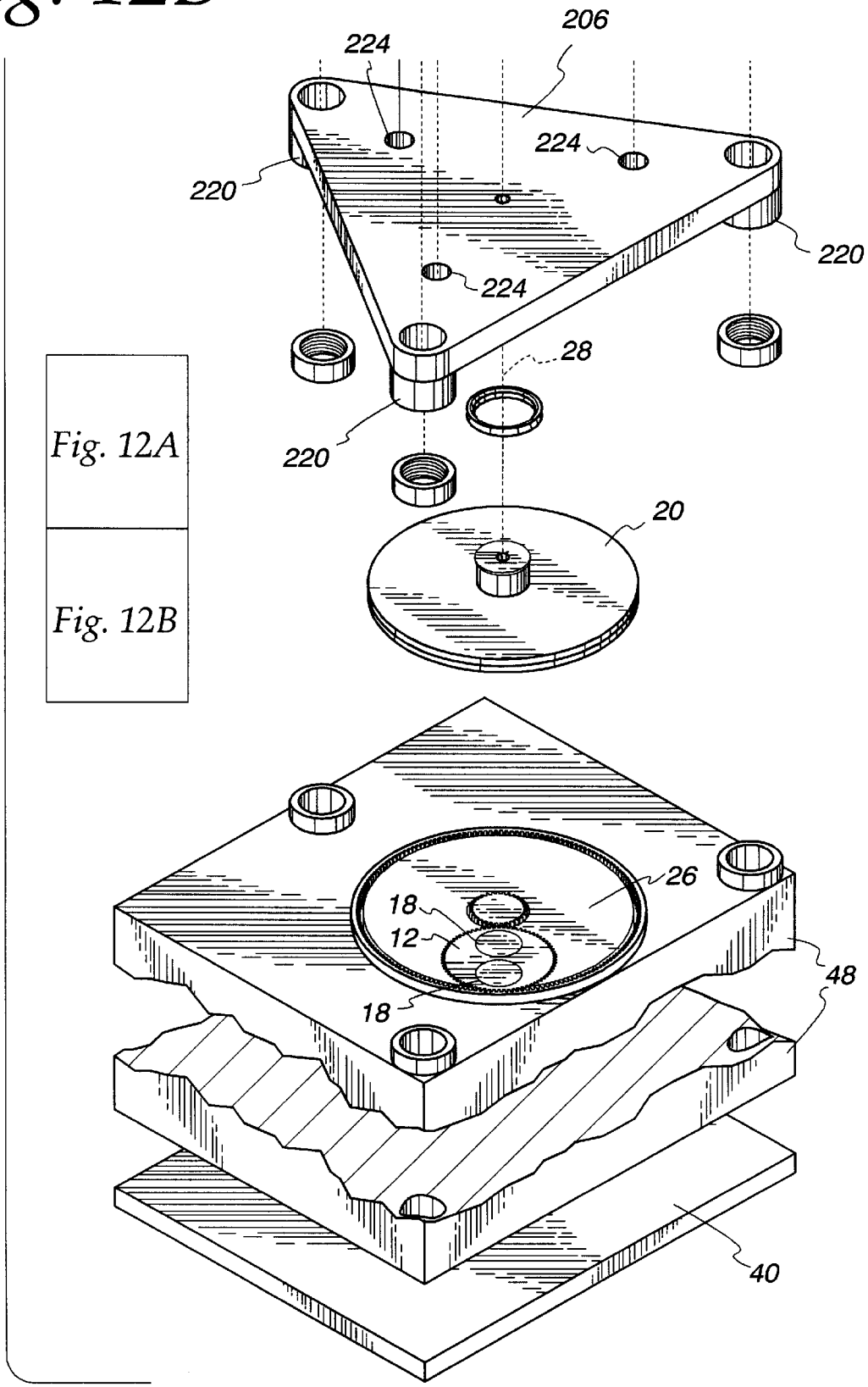

In the present invention is it preferred that the top and bottom polishing plates be provided with opposed annular polishing surfaces and that they be independently rotatably mounted along a single common axis (see dashed line 28 in FIG. 12B). Attainment of a common axis alignment or so-called "focus" has been found to be important for obtaining desirable polishing results, especially when the geared cage mechanisms are made to undergo a complex motion, as in the preferred embodiment of the present invention. In order to improve the concentric alignment of upper and lower polishing plates and to ensure such alignment during various phases of machine operation, it is generally preferred that the structure supporting the top and bottom polishing plates have their positional locating elements milled in a common milling operation with the components mounted in their respective positions, one to another.

As will be seen herein, various members of the supporting superstructure have a generally triangular configuration. It is generally preferred, therefore, that three vertical support columns 32, 34 and 36 be employed, with a triangular, generally horizontal top wall 38 extending between the upper ends of the columns (see FIG. 12A, for example). The base 40 of the framework is preferably made to have a generally rectangular shape (see FIG. 12B), although a three-sided generally triangular shape could also be employed.

Figure 2:
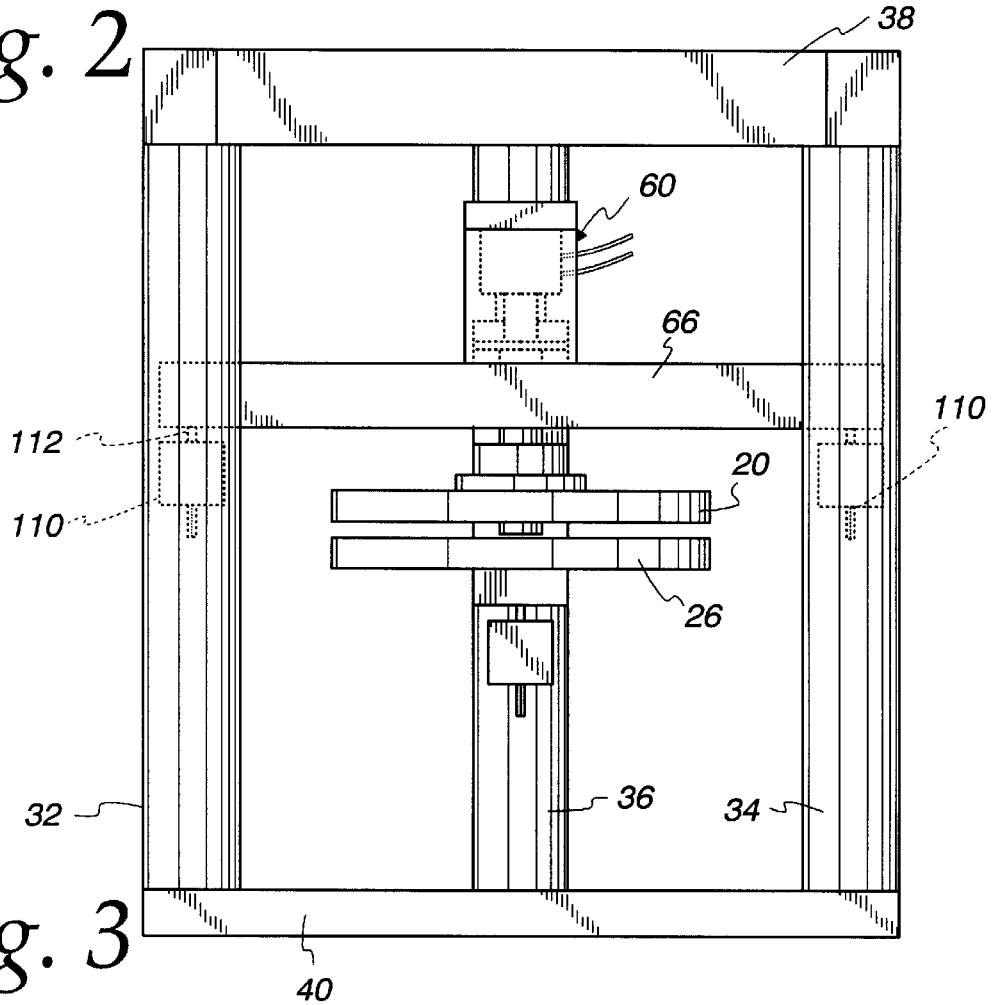
FIG. 2 is a front elevational view thereof.
Figure 3:
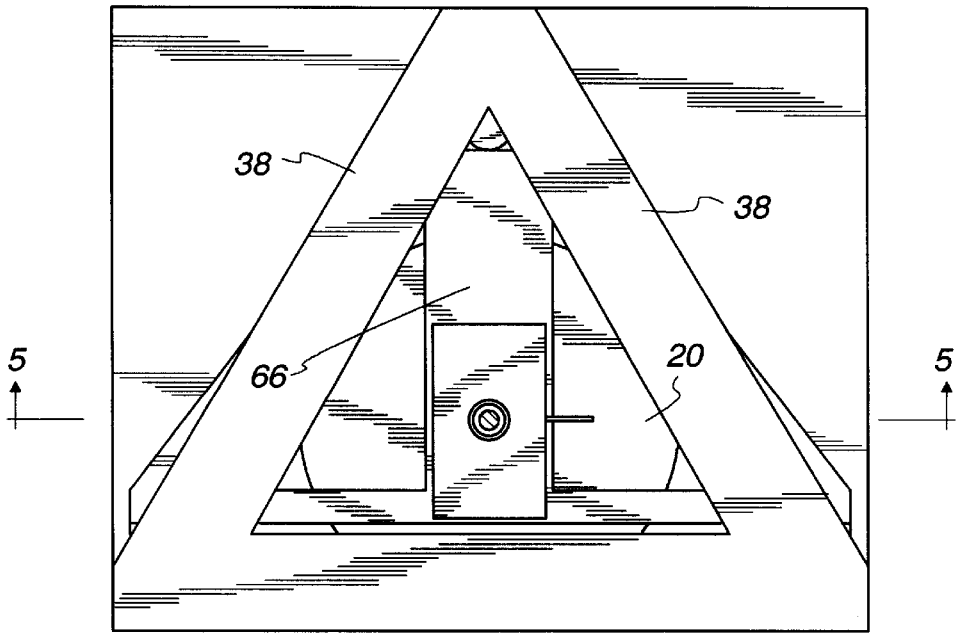
FIG. 3 is a top plan view thereof.
Figure 4:
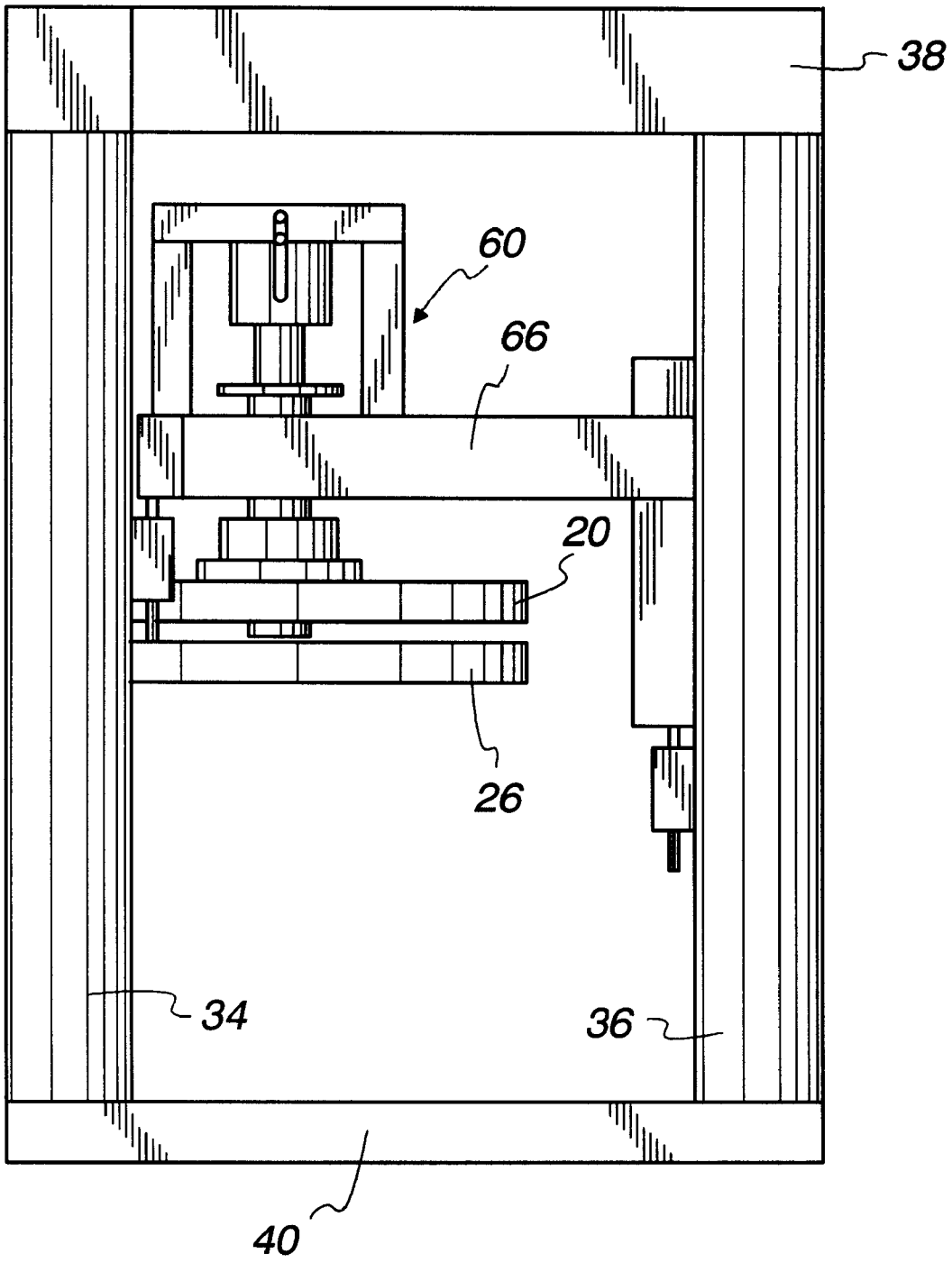
FIG. 4 is a side elevational view thereof.
Figure 5:
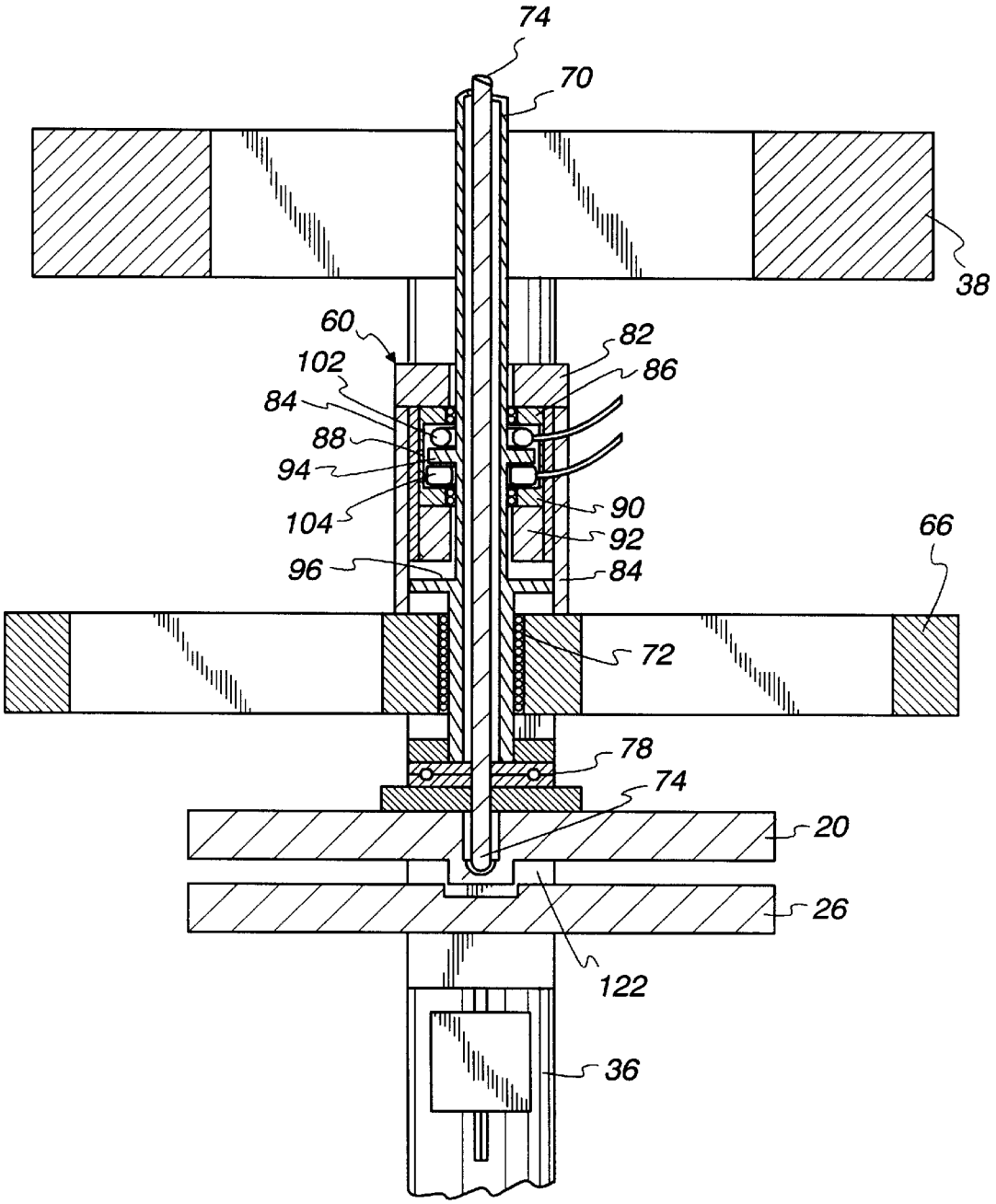
FIG. 5 is a fragmentary cross-sectional view taken along the line 5—5 of FIG. 3.

Referring to FIGS. 2 and 3, the support columns 32–36 extend from top wall 38 and are supported from below, passing through base compartment 48 (see FIG. 10) to machine base 40. Referring to FIGS. 4 and 5, a platform assembly generally indicated at 60 includes a platform 66 dimensioned for vertical movement within the support columns 32, 34 and 36.

A platform assembly generally indicated at 60, with linear bearings 72 providing sliding support, has a central support column 70 (see FIG. 5). As can be seen in FIG. 5, the central support 70 is hollow, allowing rotational drive spindle 72 to travel through the platform assembly, such that its lower end 74 is coupled to upper polish plate 20 for common rotation therewith. In the arrangement shown in FIG. 5, the central support column 70 is coupled to lifting means (e.g., rack and pinion gear assembly) not shown in the drawings, mounted atop wall 38. The lifting means engages the central support shaft 70 to raise and lower the support shaft 70 a desired amount.

As can be seen in FIG. 5, the central support shaft 70 is connected at its lower end to a bearing arrangement 78. Bearing 78 is in turn coupled to upper pressure plate 20. Rotational drive spindle 74 is free to rotate about its central axis, to thereby rotate the upper pressure plate 20. The central support column 70 is preferably mounted for raising and lowering, as mentioned, but not for rotation.

Referring again to FIG. 5, platform assembly 60 includes a support table comprised of a top wall 82 and side walls 84, the lower ends of which are attached to platform 66. A substantially complete enclosure is disposed within the table and forms a hollow cavity surrounding the central support column 70. The enclosure includes a top wall 86, cylindrical outer wall 88 and bottom walls 90, 92. Central support column 70 includes first and second protruding disk-like plate members 94, 96. The first disk 94 is disposed within the hollow cavity such that the disk 94 cooperates with the upper wall 86 to form a first chamber portion and the lower wall 90 to form a second chamber portion. The second disk 96 is disposed in the cavity formed between the bottom wall 92 and platform 66.

An upper fluidically pressurized bladder 102 is disposed in the first chamber portion, and a second fluidically pressurized bladder 104 is formed in the remaining (lower) chamber portion. The fluidically pressurized bladders 102, 104 may have an elastic (i.e., inflatable) construction or an inelastic construction with pleated walls to allow volume expansion. In the preferred embodiment, the fluidically pressurized bladders 102, 104 are formed of an elastic material, such as a rubber compound.

Referring again to FIG. 5, as the lower bladder 104 is pressurized, the bladder inflates so as to fully occupy the lower chamber portion below disk 94. As can be seen in FIG. 5, the bladder is confined by disk 94, outer cylindrical wall 88 and lower wall 90, which is supported against movement. With a further increase in pressure, bladder 104 urges disk 94 in an upward direction, reducing the volume of the upper chamber portion, thereby producing any flattening of the upper bladder 102 that may be allowed by a suitably low internal pressure.

Depending upon the pressure within upper bladder 102, the pressurized enlargement of lower bladder 104 will be halted at a certain operating point. Because disk 94 is fixed to central support column 70, which is in turn fixed to upper pressure plate 20, the position of upper pressure plate 20 and the pressure imparted to the workpieces by the upper pressure plate 20 can be readily determined. If an increase in pressure is desired, or if pressure plate 20 must be lowered a further amount, pressure may be released from lower bladder 104 allowing disk 94 to settle to a lower point within the enclosure. If desired, the pressure within upper bladder 102 may also be increased to provide a greater range of control over the upper pressure plate 20. For example, with upper and lower bladders 102, 104 remaining pressurized so as to fully inflate the chamber portions within which they are located, pressure plate 20 will be afforded increased positional stability and stiffness at any desired operating point, thereby resisting momentary dislodging forces.

As mentioned, the lower disk 96 is held captive within a chamber formed between platform 66, wall 92 and outer cylindrical wall 84. The degree of freedom allowed the lower disk 96 will, in effect, fix the range of motion of upper pressure plate 20. As will be seen herein, it is preferred to fix platform 66 at a fixed location with respect to the support structure. Lower disk 96 will preferably be positioned to contact platform 66 at some operating point to fix the lowermost displacement of upper pressure plate 20, if such should be a necessary aspect of the operation.

Referring to FIGS. 1 and 2, it is generally preferred that the platform 66 and upper pressure plate 20 be hangingly suspended from above (e.g., top wall 38) by central support column 70. As will be seen herein, in operation, the platform 66 and upper pressure plate 20 are raised and lowered together, in a common operation. During the lowering operation, the platform 66 is stopped at a predetermined point, and the upper pressure plate 20 is thereafter lowered a further amount associated with relative movement between the platform and the upper pressure plate. It is generally preferred, in this regard, that the support of the upper pressure plate 66 be made as firm and as stable as possible.

With reference to FIG. 5, it will be seen that platform 66 provides a frame of reference for linear bearing 72 and that a stable support of the linear bearings will render further lowering of the upper pressure plate more accurate. Accordingly, referring again to FIGS. 1 and 2, a plurality of adjustable stop members 110 are mounted on support columns 32, 34 and 36. Further, diamond-shaped pin supports 112 are secured to stop members 110 and are received in complementary shaped recesses formed in the underneath side of platform 66. In this manner, an accurate positioning of the platform 66 is assured, with repeatable precision for each cycle of operation of the polishing tool. If desired, the stop pins could be made adjustable. By fixing platform 66 in position, the linear bearing 72 and hence the upper polish plate 20 is also accurately fixed in position with respect to the superstructure or framework for the tool.

Referring again to FIGS. 10 and 11, the central support shaft and a rotational drive spindle are mounted within a flexible bellows-like boot 116. The rack and pinion lifting mechanism for the central support column 70 is located in enclosure 118 mounted atop top wall 88. Portions of the central support column protruding above top wall 38 are preferably contained within housing 118. Rotational drive for the spindle 74 preferably comprises a drive motor mounted atop the central support column 70, and enclosed within housing 118 with the upper pressure plate 20 being supported in pendulum fashion from top wall 38 by central support column 70. With reference to FIG. 5, the lower portion of the central support column is guided by linear bearing 72 disposed within platform 66. The lower pressure plate 26 (see FIG. 10) is supported from below by conventional support and drive mechanism disposed within housing portion 48. The support drive mechanism for lower table 26 is of conventional design and is not visible in the drawings. With reference to FIG. 5, upon completion of a polishing operation central support column 70 is raised, thereby raising upper pressure plate 20.

It is generally preferred that the initial raising of the upper polish plate 20 is effected by pressurizing lower bladder 104 and, if necessary, depressurizing upper bladder 102. In effect, the initial lifting force is transferred through table walls 84 to the platform 66. As mentioned above, this force is in turn transferred through pins 112 and support blocks 110 to support columns 32–36 and ultimately, base plate 40. The central support column 70 is then raised, as mentioned, and eventually comes into contact with the underneath surface of platform 66. Thereafter, with continued raising of central support column 70, the upper pressure plate 20, platform 66 and platform 60 carried thereon are lifted together as a single unit, to provide additional clearance between the upper and lower polish plates 20, 26 to allow convenient removal and replenishing of workpieces being polished. Thereafter, the polishing tool cycle is repeated with lowering of the upper pressure plate to begin a new polishing operation.

Initially, the central support column 70 is lowered, with the platform 66 and the associated platform assembly 60 resting atop the upper pressure plate 20. By continued lowering of central support column 70, platform 66 eventually comes into contact with support pins 112, in the manner indicated in FIG. 2. At this point it is generally preferred that the upper polish plate 20 is spaced slightly above the workpieces carried on the lower polish plate 26. If desired, the upper pressure plate could be brought directly into contact with the workpieces. However, for high precision polishing operations, it is important that movement of the upper polish plate be carefully controlled as it is brought into contact with the workpieces to be polished. In particular, it has been found important to control the final polish pressure exerted by upper pressure plate 20, as well as the rate of increase of polish pressure.

With the present invention, the rate of increase of polish pressure can be controlled in a more elaborate manner, wherein a desired operating curve representing increase of polish pressure can be repeatedly attained with precision in a commercially economic manner. In operation, with platform 66 secured in a fixed position illustrated, for example, in FIG. 2, weight of the upper polish plate 20 is borne by lower bladder 104. By decreasing the pressure in lower bladder 104, upper polish plate 20 is lowered in a manner to increase polishing pressure on workpiece carried on lower polish plate 26. Referring again to FIG. 5, reference numeral 122 indicates a key and slot arrangement in upper and lower polish plates 20, 26 to assure their mutual concentric orientation. Also, a gimbal arrangement is schematically indicated where upper polish plate 20 is secured to central support column 70.

If desired, air pressure in upper bladder 102 may be maintained at virtually any pressure level desired. In one mode of operation, this will affect the spring characteristics of the bladder combinations 102, 104 and will resist any upward excursions of the upper polish plate 20 which may be experienced during a polishing operation. Alternatively, if it is desired to provide a cushioning of such upward excursions, the pressure in upper bladder 102 can be lessened somewhat to provide the desired amount of cushioning, without removing the double acting spring loading on central support column 70.

Figure 6:
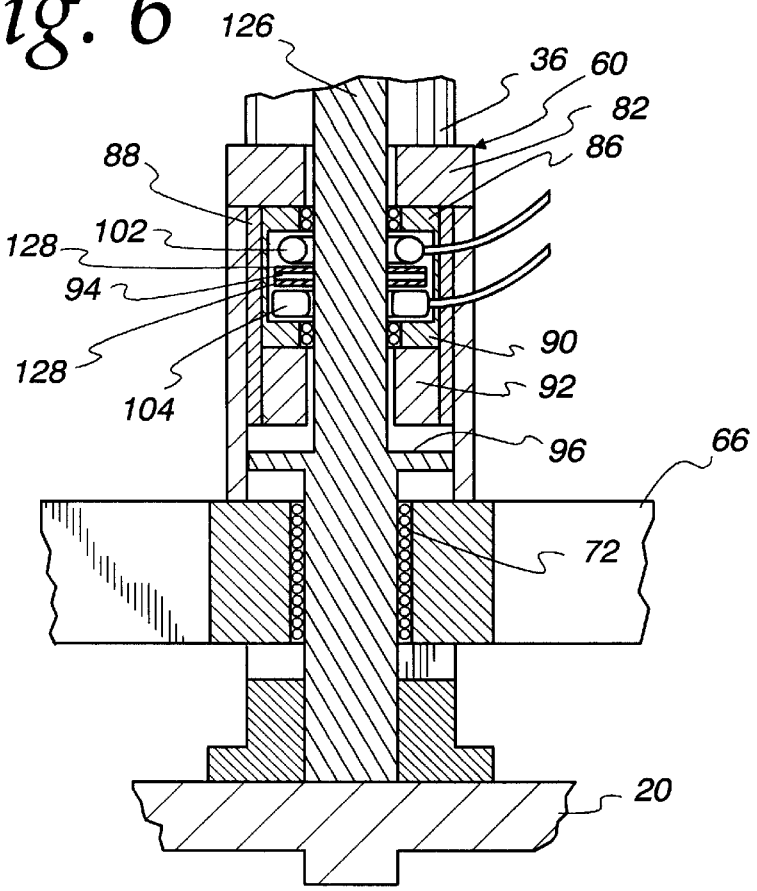
FIG. 6 is a fragmentary view of an alternative arrangement taken on an enlarged scale.

Turning now to FIG. 6, an alternative arrangement is shown for the central support column designated by the reference numeral 126. As indicated in FIG. 6, the central support column 126 provides hanging support for the upper polish plate 20, without benefit of an interiorly located drive spindle (as shown, for example, in FIG. 5 above). Rather, the central support column is rotatably driven from above by suitable drive means mounted atop top plate 38, and contained within housing 118, as shown in FIG. 10. Various arrangements can be employed to reduce frictional engagement between disk-like protrusion 94 and bladders 102, 104.

Figure 7:
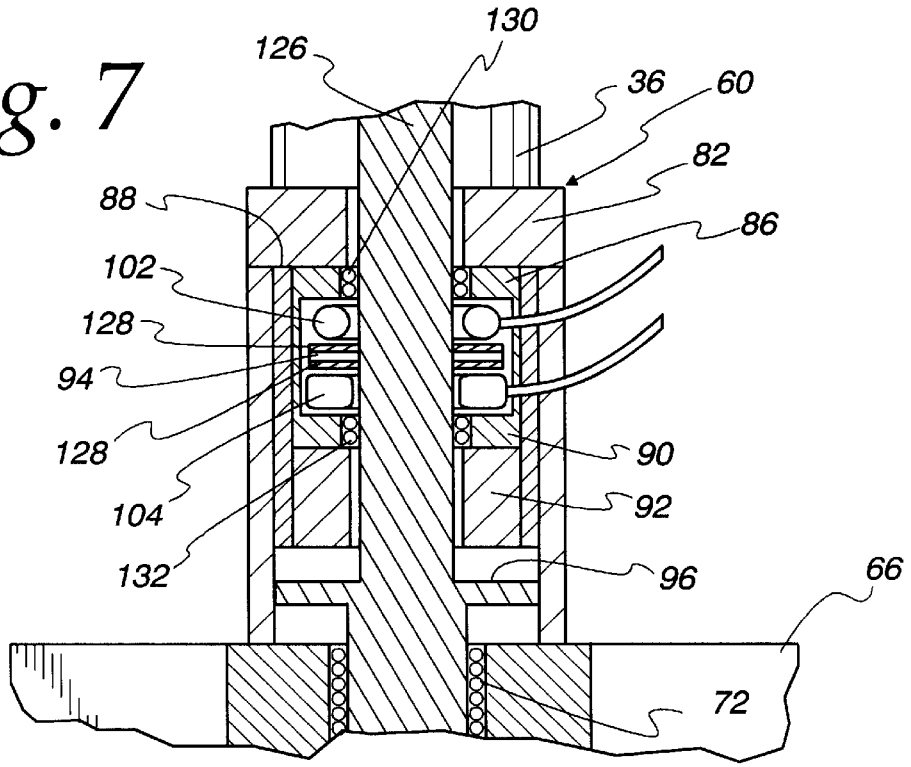
FIG. 7 shows a portion of FIG. 6 on an enlarged scale.

As shown in FIGS. 6 and 7, a pair of bearings 128 are employed, with one bearing associated with each bladder. The remaining details of the platform assembly 60 are the same as those described above in FIG. 5. For example, it is generally preferred that bearings 130, 132 be provided adjacent upper wall 86 and lower wall 90, respectively. As indicated in FIG. 7, an air gap or clearance is provided between the central support column and the upper table wall 82 and the lower enclosure wall 92. If desired, an air-tight packing could be employed in this area but such has been found to be unnecessary.

Figure 8:
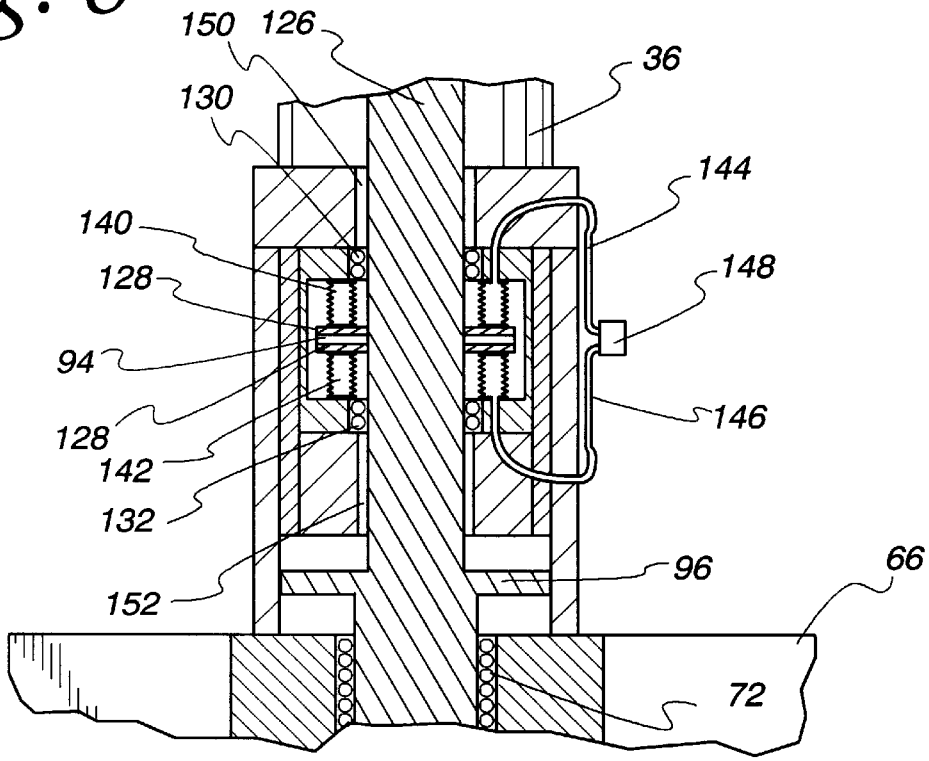
FIG. 8 is a cross-sectional view showing an alternative arrangement.

Turning now to FIG. 8, an alternative fluid control arrangement for the upper polish plate is shown. The arrangement of FIG. 8 is generally similar to that shown in FIG. 7. For example, bearings 128 are provided on either side of disk-like protrusion 94. However, the bladders of FIG. 7 are replaced with upper and lower bellows 140, 142. Fluid conduits 144, 146 are coupled at one end to a control unit 148 and pass through the walls of the surrounding enclosure so as to enter the interior of bellows 140, 142. The bellows are extendable and retractable in vertical directions but preferably, are otherwise inelastic. As shown in FIG. 8, the bellows have interior walls spaced from central support column 126. Alternatively, if desired, the bellows could have an open interior with fluid pressure bearing against the outer surface of central support column 126. In this latter alternative, pressure tight packing or other sealing means is preferably provided in cavities 150, 152.

Figure 9:
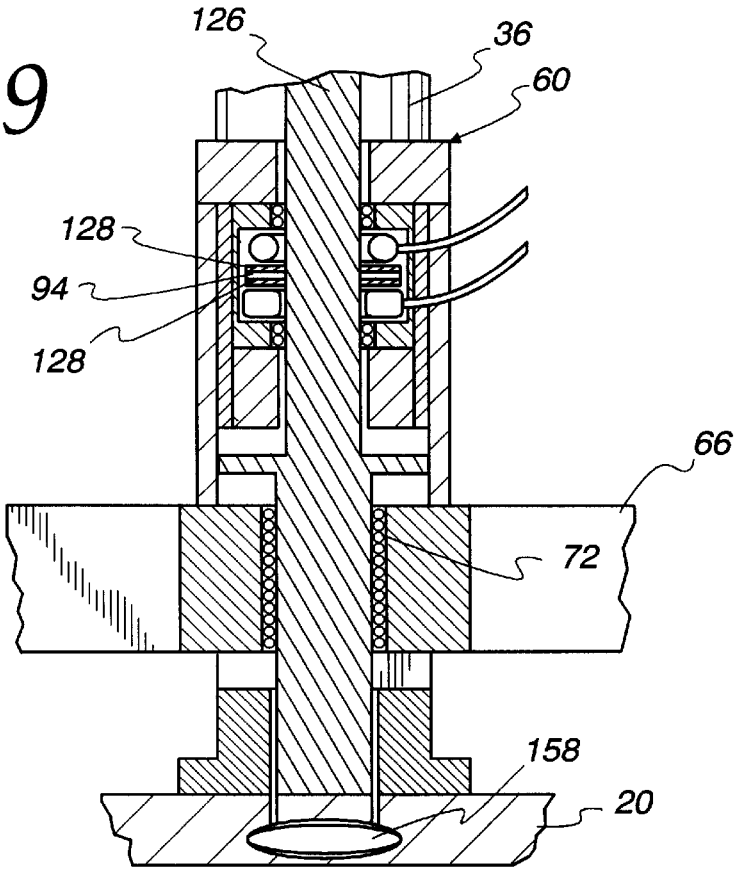
FIG. 9 is a fragmentary cross-sectional view similar to that of FIG. 6 but showing an alternative arrangement for mounting the upper polish plate.

Turning now to FIG. 9, an arrangement for supporting upper polish plate 20 is substantially similar to that shown above with respect to FIG. 6, except for the provision of a gimbal mounting 158 to allow upper polish plate 20 to rock slightly as pressing engagement is applied to the workpieces. In one mode of operation, gimballing allows the upper polish plate to achieve a close contact engagement with an array of workpieces carried on the lower polish plate, despite variations in workpiece thickness. Without the gimballing arrangement, polishing forces would initially be concentrated on the thicker workpieces, with the thinner workpieces receiving a lesser working pressure, until sufficient material is removed from the thicker workpieces to make workpiece thickness uniform throughout.

Figure 14:
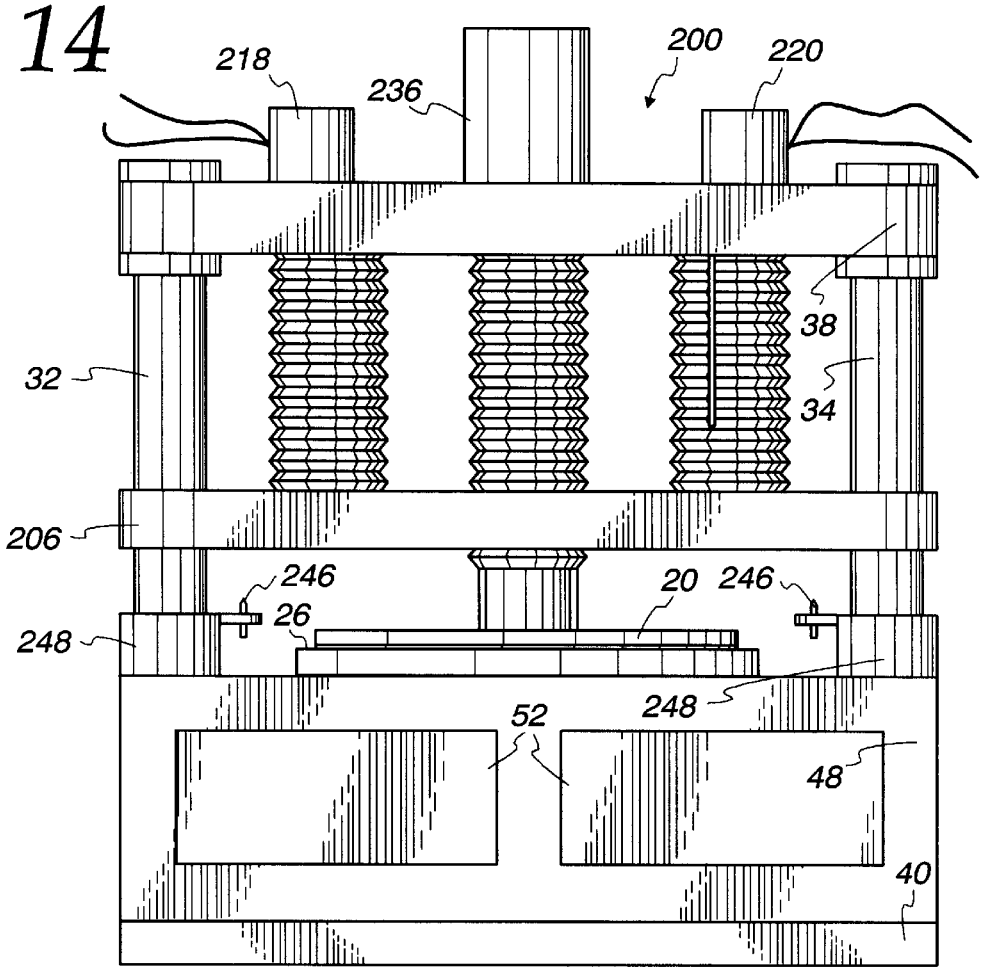
FIG. 14 is a front elevational view thereof.
Figure 13:
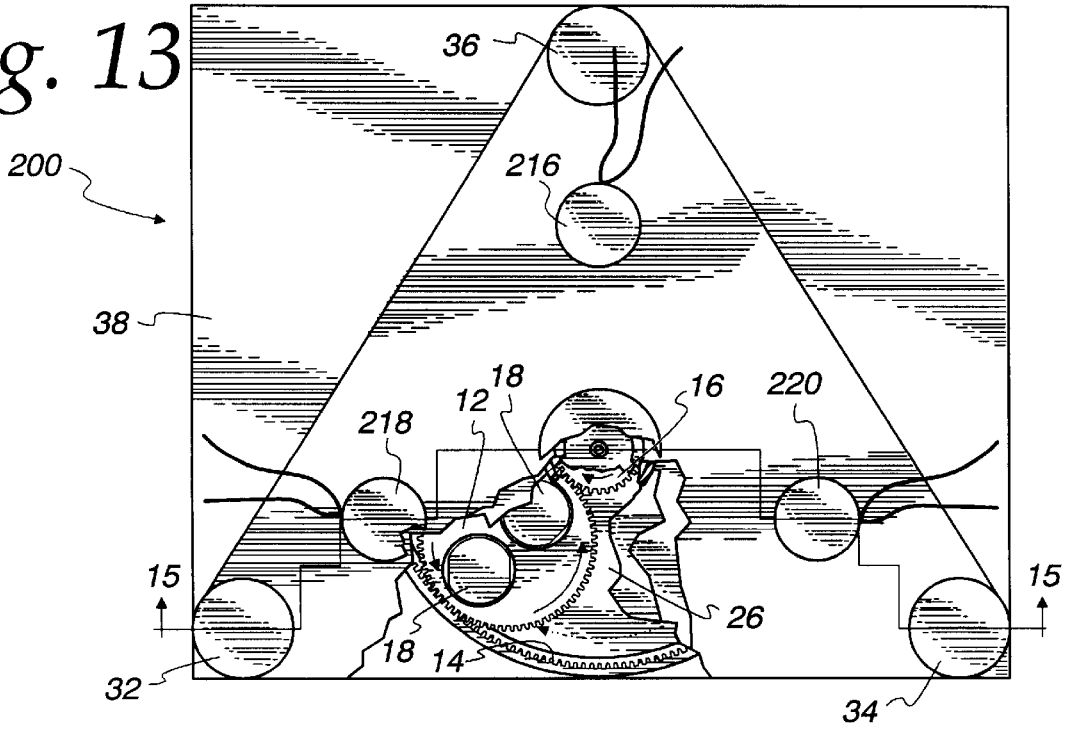
FIG. 13 is a top plan view, shown partly broken away, of a polishing machine incorporating the apparatus of FIG. 12.

Turning now to FIGS. 12–15, a further embodiment of the polishing tool is generally indicated at 200 (see FIGS. 13 and 14). Many of the features of polishing tool 200 are the same as those described above. For example, referring to FIGS. 13 and 14, the support columns 32, 34 and 36 extend form top wall 38 and are supported form below, passing through base compartment 48 to machine base 40. A platform 206 slides up and down along support columns 32–36. Ball screw members 210 provide connection for platform 206 with screw shafts or threaded rods 210, 212 and 214. The threaded rods 210,212 and 214 are in turn supported from above by top wall 38 and are rotatably driven by drive motors 216, 218 and 220 (see FIG. 12A).

Figure 15:
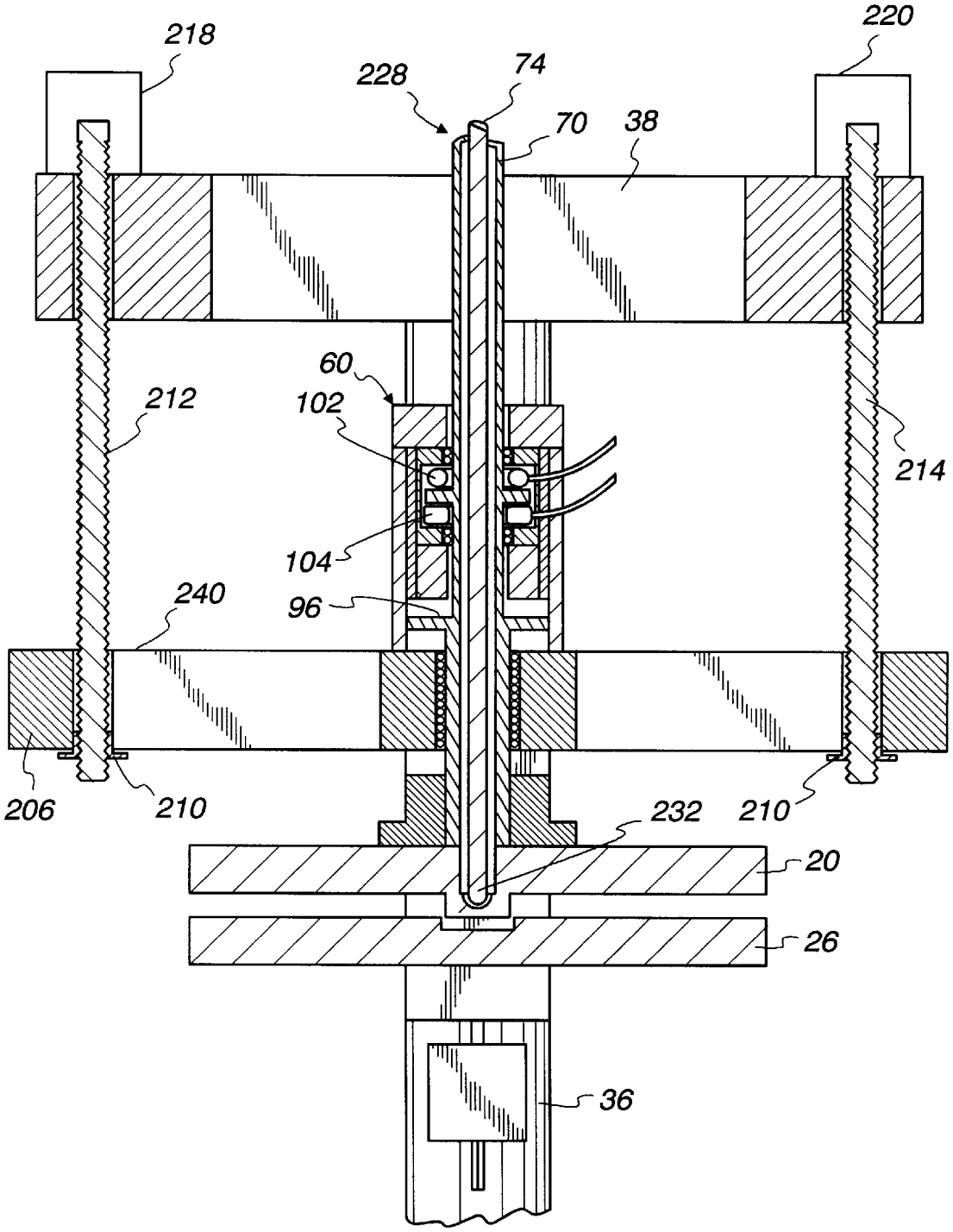
FIG. 15 is a fragmentary cross-sectional view taken along the line 15—15 of FIG. 13.

Referring to FIG. 15, when a polishing operation is completed, and a "soft release" is desired, pressure in lower bladder 104 is increased and, if necessary, pressure in upper bladder 102 is decreased, in the manner described above, so as to raise upper polish plate 20 an initial amount. Thereafter, the drive motors 216, 218 and 220 are energized so as to rotate the threaded rods 210, 212 and 214 to thereby raise platform member 206. With continued raising, the upper surface 240 of the platform engages the disk-like protrusion 96 affixed to central support column 70. Thereafter, with continued rotation of threaded rods 210, 212 and 214, central support column 70 and hence upper polish plate 20 are raised, traveling with platform 240 in an upward direction to provide increased clearance between upper and lower polish plates 20, 26.

After the workpieces are replenished, the polishing tool is ready for a new cycle of operation. Initially, drive motors 216, 218 and 220 are energized to turn threaded shafts 210, 212 and 214 in an opposite direction, so as to lower platform 206, the platform assembly 60 carried thereon and the central support column 70 with upper polish plate 20, traveling therewith. During this period of operation, the disk-like protrusion 96 remains in engagement with the upper surface 240 of platform 206. With continuing rotation of the threaded shafts 210, 212 and 214, the bottom surface of platform 206 is brought into contact with adjustable guide pins 246 which are mounted for vertical adjustment on brackets extending from support collars 248. The guide pins 246 may have a threaded exterior surface for vertical adjustment or, alternatively, the stop collars 248 could be threadingly engaged with support columns 32, 34 and 36 (with or without the guide pins 246) to provide a vertical stop adjustment for the platform 206. With continued rotation of threaded rods 210, 212 and 214, platform 206 is lowered into contact with guide pins 246 and motors 216, 218 and 220 are de-energized. It is generally preferred at this point in time that the upper polish plate 20 is spaced at least slightly above the lower polish plate 26, and with the platform 206 secured in a fixed, stable position. With a decrease of pressure in bladder 104 or an increase in pressure in upper bladder 102, or both, the central support column 70 and hence the upper pressure plate 20 carried at the bottom thereof, is lowered a further amount until the desired polishing pressure is attained. As mentioned above, use of the fluidically pressurized bladders allows precise control over the change and rate of change of polishing pressures. Further, by employing multiple bladders, the double action control of the upper polish plate can be readily attained in a manner to effectively dampen or otherwise control vibrations on excursions in the upper polish plate during a cycle of operation.

As with the preceding embodiments described herein, the weight of the platform and platform assembly is greater than the downward force needed to produce the desired polishing pressures. Accordingly, it is not necessary to drive the threaded rods 210, 212 and 214 after engagement to produce the desired polishing pressures. As mentioned, it is preferred, however, that downward force be increased by increasing pressure in the upper bladder 102 although, in the preferred embodiment, this increased downward force is relatively small in comparison to the weight of the upper polish plate and components associated therewith, such as the central support column 70. Although generally not preferred, it is possible to omit operation of the fluidically pressurized bladders 102, 104, by controlling polishing pressures with the threaded rods 210, 212 and 214.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. An apparatus for polishing a workpiece, comprising:

a frame;

an upper polish plate;

a lower polish plate positioned beneath said upper polish plate;

a plate support shaft extending upwardly from said upper polish plate and having a central axis;

mounting means for mounting said plate support shaft for reciprocation in vertical directions and for rotation about its central axis;

a platform carried by said shaft for travel therewith, with said plate support shaft passing through said platform;

platform support means carried by said frame to engage said platform in a fixed position while allowing movement of said shaft relative to said platform; and positioning means comprising a double-acting fluidically pressurized bladder means carried by said platform and engaging said plate support shaft for displacing said plate support shaft and hence said upper polish plate with respect to said platform, so as to move said upper polish plate toward and away from said lower polish plate.

2. The polishing apparatus of claim 1 wherein said platform support means comprises a plurality of stop blocks supported by said frame so as to interfere with said platform means so as to limit the movement thereof, and so as to support said platform means at a fixed position above said upper polish plate.

3. The polishing apparatus of claim 2 wherein said stop blocks are adjustably positionable with respect to said frame.

4. The polishing apparatus of claim 1 wherein said first and second platform members have a generally triangular configuration and said frame includes a generally triangular top wall providing hanging support for said upper polish plate.

5. The polishing apparatus of claim 4 further comprising cooperating alignment means on said upper and said lower polish plates to align said upper and said lower polish plates in registration as said upper ends of lower polish plates are brought together.

6. The polishing apparatus of claim 1 wherein said upper polish plate has a central axis and said polishing apparatus further comprises means for rotating said upper polish plate about said central axis.

7. The polishing apparatus of claim 1 further comprising cooperating sun gear means, ring gear means and a plurality of geared carrier means coplanar aligned with and disposed between said sun gear means and said ring gear means, with said sun gear means, said rain gear means, and said plurality of geared carriers carried on said bottom polish plate such that said geared carriers are rotated about their respective central axes as the geared carriers are rotated about the central axis of the lower polish plate.

8. The polishing apparatus of claim 1 wherein said positioning means comprises a chamber carried on said upper polish plate, a protrusion carried on said plate support shaft and disposed within said chamber and first and second pressure-tight vessels having outer walls and disposed within said chamber, one on either side of said protrusion, with said outer walls engaging said protrusion to displace said plate support shaft with respect to said platform.

9. The polishing apparatus of claim 8 wherein at least one of said first and said second pressure-tight vessels has outer elastic walls which alter size in response to pressure within said at least one vessel.

10. The polishing apparatus of claim 9 wherein said at least one vessel is inflatable.

11. The polishing apparatus of claim 9 wherein said at least one vessel comprises a bellows.

12. The polishing apparatus of claim 8 wherein at least one of said first and said second pressure-tight vessels cooperates with said protrusion to form a bellows therewith.

13. The polishing apparatus of claim 12 wherein the outer wall of said at least one pressure-tight vessel is substantially inelastic, with most of the force developed against said protrusion being associated with opening with said bellows.

14. The polishing apparatus of claim 1 further comprising transport means for transporting said platform support means and said positioning means toward and away from said lower polish plate.

15. The polishing apparatus of claim 14 wherein said transport means comprises means for raising and lowering said plate support shaft and first interengaging means carried on said platform for engaging said plate support shaft so as to be carried therewith as said plate support shaft is raised and lowered.

16. The polishing apparatus of claim 14 wherein said transport means comprises means for raising and lowering said platform and second interengaging means carried on said plate support shaft for engaging said platform so as to be carried therewith as said platform is raised and lowered.

17. The polishing apparatus of claim 16 wherein said platform has a generally triangular configuration and said frame includes support columns passing through apertures formed in said second platform so as to provide sliding support therefor.

18. The polishing apparatus of claim 17 wherein said frame includes a generally triangular top wall providing hanging support for said platform and said means for moving said first platform member toward and away from said lower polish plate comprise platform hanging means for hangingly supporting said first platform member from said top wall.

19. The polishing apparatus of claim 18 wherein said transport means comprises a plurality of rotatively driven rods threadingly engaging said first platform member.

* * * * *